US007788758B2

(12) United States Patent
Konishi et al.

(10) Patent No.: US 7,788,758 B2
(45) Date of Patent: Sep. 7, 2010

(54) WATER DISINTEGRABLE CLEANING UTENSIL

(75) Inventors: Takayoshi Konishi, Kanonji (JP); Kazuya Okada, Kanonji (JP)

(73) Assignee: Uni-Charm Corporation, Ehime (JP)

( * ) Notice: Subject to any disclaimer, the term of this patent is extended or adjusted under 35 U.S.C. 154(b) by 948 days.

(21) Appl. No.: 11/382,335

(22) Filed: May 9, 2006

(65) Prior Publication Data

US 2006/0254012 A1 Nov. 16, 2006

(30) Foreign Application Priority Data

May 13, 2005 (JP) ..... 2005-141435

(51) Int. Cl.
*A47K 11/10* (2006.01)

(52) U.S. Cl. ..... 15/210.1; 15/222; 15/226

(58) Field of Classification Search ..... 15/210.1, 15/222, 150, 226
See application file for complete search history.

(56) References Cited

U.S. PATENT DOCUMENTS

| | | | | |
|---|---|---|---|---|
| 5,470,653 | A | 11/1995 | Honeycutt et al. | |
| 7,127,768 | B2 * | 10/2006 | Blum et al. | 15/104.94 |

FOREIGN PATENT DOCUMENTS

| | | |
|---|---|---|
| EP | 1166707 | 1/2002 |
| JP | 62-186833 A | 8/1987 |
| JP | 9-503426 | 4/1997 |
| JP | 2001-064858 | 3/2001 |
| JP | 3105217 | 8/2004 |
| JP | 2004-298650 | 10/2004 |
| WO | WO-96/04136 | 2/1996 |

OTHER PUBLICATIONS

International Search Report dated May 16, 2006 issued for corresponding International Patent Application No. PCT/JP2006/307944.
Official Action from corresponding Japanese Patent Application No. 2005-141435 issued Jun. 15, 2010 with English translation, 6 pages.

* cited by examiner

*Primary Examiner*—Shay L Karls
(74) *Attorney, Agent, or Firm*—Brinks Hofer Gilson & Lione

(57) ABSTRACT

A water disintegrable cleaning utensil of the present invention has: a cleaning part, at least part of which is formed by a wet shrinkable resin being hydrophilic and shrinkable at least in one direction when absorbing water; and a holding part which holds the cleaning part. By this structure, the water disintegrable cleaning utensil is very effective at cleaning both in a dry and in a wet condition and is disintegrable in water when being disposed of after being used.

5 Claims, 7 Drawing Sheets

WATER DISINTEGRABLE CLEANING UTENSIL

INCORPORATION BY REFERENCE

This application claims the benefit of priority from Japanese Patent Application No. 2005-141435, filed May 13, 2005, which is incorporated by reference in its entirety.

BACKGROUND OF THE INVENTION

1. Field of the Invention

The present invention relates to a water disintegrable cleaning utensil capable of wiping and cleaning both in a dry and in a wet condition and disposable in water after being used.

2. Description of the Related Art

Japanese Patent Unexamined Publication No. S62-186833 discloses an invention related to a disposable toilet cleaning brush used for cleaning a flush toilet.

The toilet cleaning brush uses paper made of short fibers being woody pulp and of a binder such as CMC. Pluralities of slits are formed on the paper. The paper is wound up into a brush. The toilet cleaning brush is fixed to the end of a handle made of paper. After a toilet bowl has been swept with the toilet cleaning brush, the toilet cleaning brush and the handle are disposed of in a flush toilet and disintegrated in water. The above application also states that wax is applied to the surface of the brush to adjust a time during which the paper is dissolved.

SUMMARY OF THE INVENTION

According to the specification of Japanese Patent Unexamined Publication No. S62-186833, since it takes only 10 to 20 seconds to clean a toilet bowl, the bowl can be cleaned before the paper composing the toilet cleaning brush dissolves in water.

However, the toilet cleaning brush formed by the paper made of woody pulp fixed with water soluble CMC decreases in bonding strength between the fibers at the time when it touches water in cleaning the toilet bowl, significantly decreasing in paper strength, which makes it difficult to wipe out dirt sticking on the bowl. In the brush to which wax is applied, a wax component inhibits the paper from dissolving, so that it takes the brush a long time to dissolve inside a septic tank.

Since the brush formed by paper is extremely soft, even when a dry part to be cleaned is cleaned by the toilet cleaning brush, it is difficult to effectively remove dust and trash.

The present invention has been made to solve the above conventional problems and has for its purpose to provide a water disintegrable cleaning utensil effective at removing dirt both in a dry and in a wet condition and disintegrable for a shorter time when it is disposed of in the bowl of a flush toilet after being used.

According to one aspect of the present invention, there is provided a water disintegrable cleaning utensil comprising: a cleaning part at least part of which is formed by a wet shrinkable resin being hydrophilic and shrinkable at least in one direction when absorbing water; and a holding part which holds the cleaning part.

In the water disintegrable cleaning utensil according to the present invention, a wet shrinkable resin forming the cleaning part fulfils its function in sweeping trash and dust in dry condition. When it is used for cleaning a bowl in the flush toilet, the wet shrinkable resin of the cleaning part absorbs water, shrinks, and turns into a mass-shaped soft aggregate. The aggregate is suited to rub off dirt sticking to the toilet bowl and the like.

For example, according to the present invention, the cleaning part is provided with a large number of fibers made of a wet shrinkable resin, and the fibers made of the wet shrinkable resin are formed by a tow.

It is preferable that the fiber made of the wet shrinkable resin decreases in length by 20% or more when absorbing ion exchange water with a temperature of 20° C. weighing three times more than the fiber.

In the present invention, the cleaning part is provided with film made of a wet shrinkable resin. In this case, the film made of the wet shrinkable resin can be provided with a plurality of strips separated by cuts.

According to the present invention, the holding part can be structurally provided with a water disintegrable holding material for holding the wet shrinkable resin, thereby the shape of the holding part can be kept in dry condition, which makes it possible to clean with the holding part held in the hand, or attached to the holder.

Therefore, the present invention is such that a holder is provided for detachably holding the holding part. The use of the holder makes it possible to firmly hold the cleaning utensil in cleaning both in a dry and a wet condition and to dispose of the utensil in a flush toilet without touching it after use.

BRIEF DESCRIPTION OF THE DRAWINGS

The invention will now be described with reference to the accompanying drawings wherein;

FIG. 2A is a perspective view showing a tow made of fibers used for the cleaning utensil, and FIG. 2B is a perspective view showing a bundle made of fibers used for the cleaning utensil;

FIG. 3A is a perspective view showing the bundle provided with a holding member, and FIG. 3B is a perspective view showing a finished cleaning utensil;

DETAILED DESCRIPTION OF THE PREFERED EMBODIMENT

Hereinafter, description will be made of embodiments of the present invention with reference to the drawings.

Figure 1:
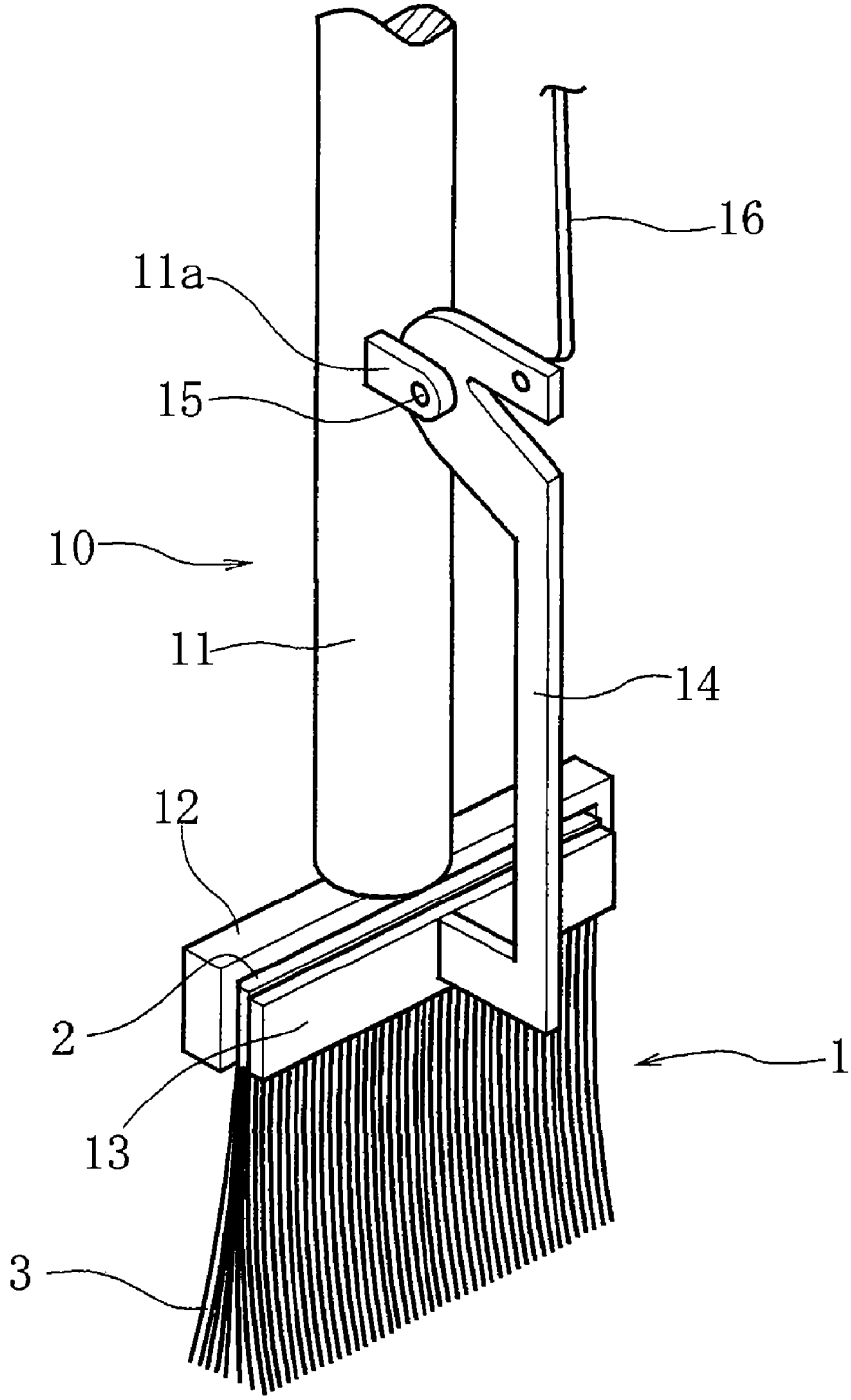
FIG. 1 is a perspective view showing a water disintegrable cleaning utensil held by a holder according to a first embodiment of the present invention.

FIG. 1 shows a state where a water disintegrable cleaning utensil according to the present invention is held by a holder. FIGS. 2A and 2B and FIGS. 3A and 3B show the water disintegrable cleaning utensil according to the first embodiment held by the holder illustrated in FIG. 1.

A wet shrinkable resin in the present invention refers to a wet shrinkable fiber or film used in the shape of a fiber or film. In other words, the "wet shrinkable resin" refers to such that a fiber absorbs water to swell, thereby shrinking and decreasing in length by 20% or more, or film absorbs water to swell and to thicken, thereby decreasing in area by 20% or more.

Figure 3A:
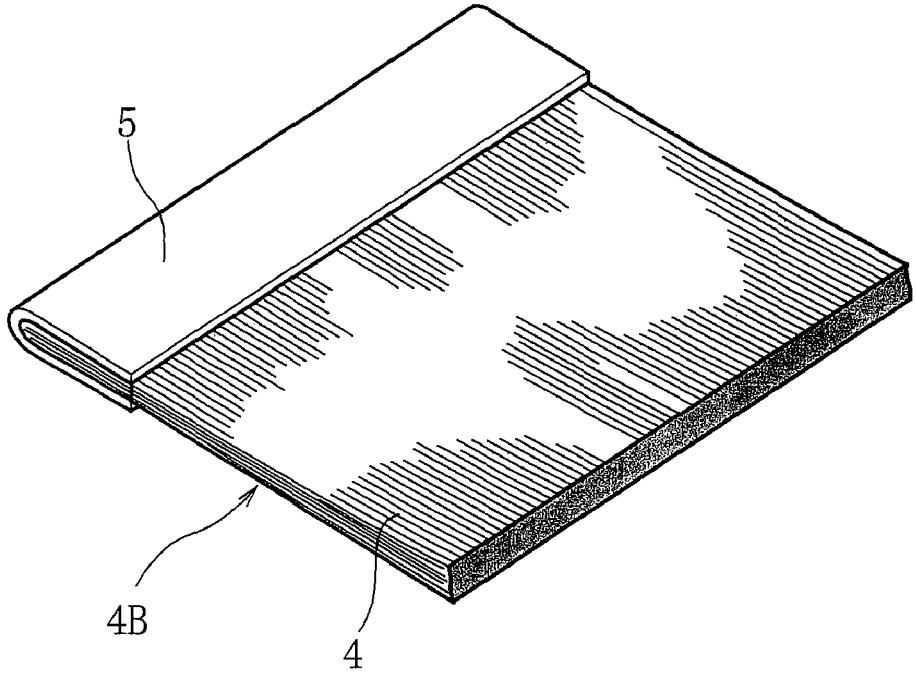
FIGS. 3A and 3B are perspective views showing a manufacturing process for the water disintegrable cleaning utensil according to the first embodiment.
Figure 3B:
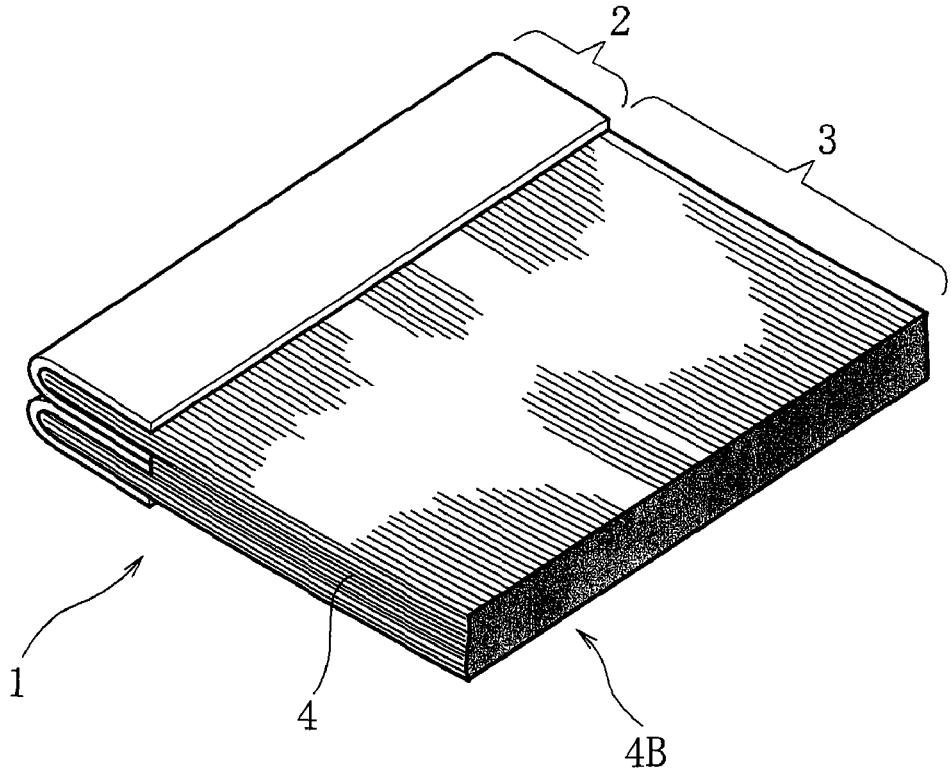

FIG. 3B shows a water disintegrable cleaning utensil 1 according to the first embodiment. The water disintegrable cleaning utensil 1 has a holding part 2 and a cleaning part 3. The holding part 2 of the cleaning utensil 1 is detachably attached to a holder 10 shown in FIG. 1.

The holder 10 shown in FIG. 1 is provided with a supporting part 12 integrally formed on the tip of a handle part 11 made of synthetic resin and a pressing part 13 opposing the supporting part 12. The supporting surface of the supporting part 12 is flat and that of the pressing part 13 opposing the supporting part 12 is also flat. The supporting part 12 opposes the pressing part 13 so that the supporting surfaces are in parallel with each other. The pressing part 13 is integrally formed with a lever 14 which is rotatably and pivotably supported by a bracket 11*a* formed on the handle part 11 through a shaft 15. An operation wire 16 is rotatably connected to the upper part of the lever 14.

A torsion spring (not shown) is attached to the shaft 15 to energize the lever 14 clockwise in the figure using the shaft 15 as a fulcrum, thereby energizing the pressing part 13 in the direction in which the pressing part 13 approaches the supporting part 12. The upper portion of the handle part 11 is provided with a handle to which an operation lever is attached. The operation wire 16 is a thick wire, and the upper end thereof is connected to the operation lever. When the operation lever is pulled upward, the lever 14 is rotated counterclockwise to cause the pressing part 13 to leave the supporting part 12. At this point, the holding part 2 of the cleaning utensil 1 is inserted between the supporting part 12 and the pressing part 13 and then the operation lever is released, thus the holding part 2 of the cleaning utensil 1 is held between the supporting part 12 and the pressing part 13 by the energizing force of the torsion spring.

With the cleaning utensil 1 held in the holder 10, a dry part such as a floor around a toilet bowl and a wet part inside the toilet bowl can be cleaned with the cleaning part 3 of the cleaning utensil 1. It is possible to wipe the toilet bowl by the cleaning part 3 wetted with water reserved in the toilet bowl. After cleaning work has ended, the operation lever is pulled upward to release the pressing force by the pressing part 13, thereby disposing of the cleaning utensil 1 without touching the cleaning utensil 1.

The cleaning part 3 of the cleaning utensil 1 is formed by fibers 4 made of wet shrinkable resin that shrinks when absorbing water. The fibers 4 made of wet shrinkable resin are formed by water soluble resin such as polyvinyl alcohol (PVA) resin or the like, or water swelling resin which absorbs water to swell. The fiber absorbs water to swell and, as a result, it shrinks and decreases in length. The fiber 4 used in the cleaning utensil 1 according to the present embodiment is PVA resin fiber of the product number "VPB101" by KURARAY CO., LTD., and its denier is 1.7 dtex. The fiber 4 is not subjected to a crimping treatment and is not shrunk. The fiber 4 preferably ranges in denier from 0.6 to 7.8 dtex.

The fiber 4 to be used will absorb water weighing three times or more than the original weight of the fiber. The fiber 4 decreases in length by 20% or more when absorbing ion exchange water with a temperature of 20° C. weighing three times more than the original weight of the fiber.

Figure 2A:
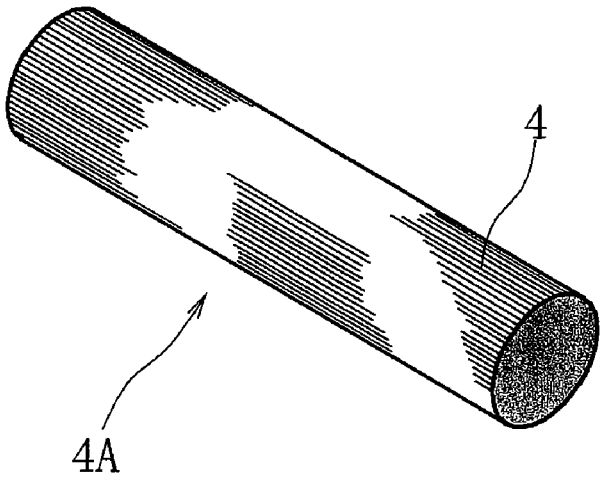
FIGS. 2A and 2B are perspective views showing a manufacturing process for the water disintegrable cleaning utensil according to the first embodiment.

FIG. 2A shows a tow 4A being a bundle of the fibers 4. The tow 4A made of a large number of the fibers 4 is mechanically (physically) compressed, as a result of which, an intermolecular contacting force between the fibers brings the fibers 4 into close contact with each other, keeping a cylindrical shape. The tow 4A is continuous. When the cleaning utensil 1 is manufactured, the tow is cut into about 30 mm to 100 mm in length, for example, into 50 mm in length to use it. Formation of the cleaning part 3 by the tow 4A falling within the range of the length mentioned above causes the cleaning part to facilitate function as a brush to remove trash and dust. Even when the tow is flushed down the toilet, it is easily flowed into a septic tank without clogging pipes as long as the fibers fall within the range of the length mentioned above.

Figure 2B:
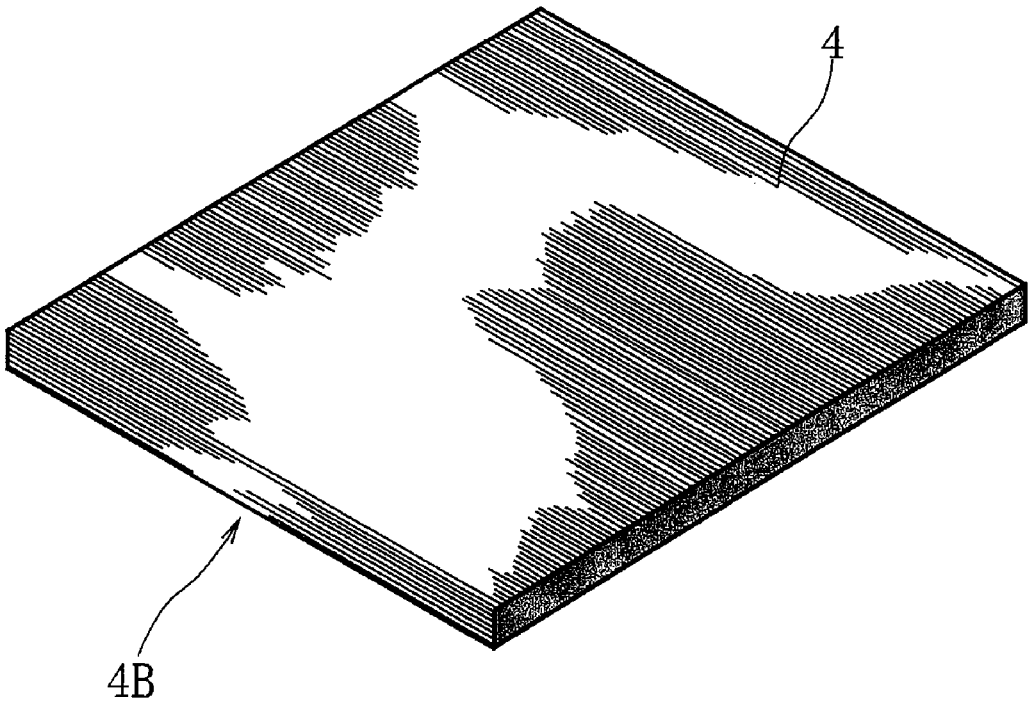

As shown in FIG. 2B, the tow 4A cut into the above length is spread in the direction perpendicular to the fiber to form a flat fiber bundle 4B with a predetermined width and thickness. When the fiber bundle 4B is formed, mechanical (physical) bonding state between the fibers 4 in the tow 4A (i.e., state where the fibers are compressed to be contacted by an intermolecular contacting force) is left at least part of the fiber bundle 4B without passing through a process in which the tow 4A is opened and each fiber is dispersed. Preferably 50% or more, and more preferably 70% or more of the fibers in the fiber bundle 4B are kept contacted by the intermolecular contacting force.

The fiber bundle 4B is an aggregate of fibers made of uncrimped PVA resin. Since the fibers 4 are brought into close contact with each other and kept contacted mechanically (physically), the fiber bundle 4B is high in stiffness and elasticity.

As shown in FIG. 3A, one end of the fiber bundle 4B is covered with a holding material 5, and the inside surface of the holding material 5 and the fiber bundle 4B are bonded to each other by water soluble adhesive. Although the above article shown in FIG. 3A can be used as the cleaning utensil 1, in the cleaning utensil 1 according to the first embodiment, as shown in FIG. 3B, a plurality of cleaning unit bodies, each being formed by the fiber bundle 4B and the holding material 5, are stacked and the holding materials 5 of the cleaning unit bodies are bonded to each other by water soluble adhesive.

As shown in FIG. 1, when the cleaning utensil 1 is used, the holding part 2 is held between the supporting part 12 of the holder 10 and the pressing part 13. For this reason, the holding part 2 of the cleaning utensil 1 needs to keep its shape until it is attached to the holder 10, but does not need to firmly hold the fiber bundle 4B. The holding material 5 is formed by water disintegrable paper strengthened by hydrogen bonding force by making natural fiber such as pulp fiber into paper or by making natural fiber such as pulp fiber and regenerated cellulose fiber such as rayon yarn into paper. The holding material 5 may be water disintegrable paper of which pulp fiber or rayon yarn is bonded with such binder as PVA or carboxymethyl cellulose (CMC) or the like. Alternatively, the holding material 5 may be formed by water-soluble resin film such as PVA film and the like.

The fiber bundle 4B and the holding material 5 may be subjected to pressure in the holding part 2 or subjected to embossing finish for heating and pressing to be bonded by providing a mechanical compressive force for the holding part 2 and the fiber bundle 4B. It is allowable to use both bonding by the above water-soluble adhesive and the embossing finish.

The fiber bundle 4B provided at the cleaning part 3 of the cleaning utensil 1 forms a brush in which the fibers are brought into close contact with each other and aggregated, as is the case with the tow 4A. The brush part is high in stiffness and elasticity. When a dry part such as a floor around a toilet bowl in a flush toilet is swept by the brush of fiber bundle 4B, dust such as hairs and cotton dust and trash on the floor are intertwined between the fibers 4 and removed.

When the inner surface of the toilet bowl is cleaned by the cleaning part 3 of the cleaning utensil 1, impregnating the cleaning part 3 with water causes the fibers 4 to absorb water and shrink so that the fibers 4 decrease in length. A part of the fibers dissolves, and the fibers are bonded together, thereby PVA resin fibers turn into a mass with high density. The mass has absorbed a large quantity of water and exhibits a cushion property like a sponge.

When the surface of the toilet bowl is rubbed with the mass made of PVA resin fiber that has absorbed water, the mass having high density and exhibiting cushion property is brought into close contact with the inner surface of the toilet bowl and the cushion property can extend its contact area. Rubbing the bowl surface with this mass can remove dirt sticking on the surface. Pressing the mass of the PVA resin fibers on the bowl surface causes water contained in the mass to exude between the mass and the bowl surface, and the water effectively removes dirt caked on the bowl surface.

After cleaning, the cleaning utensil 1 is disposed of in the toilet bowl and flushed with wash water, then a large amount of water separates the holding material 5 from the fiber bundle 4B (an aggregate of PVA resin) and the fiber bundle 4B disperses in the water, flows into a septic tank without clogging pipes, and dissolves on the way to the septic tank or in the tank. Moreover the fibers in the holding material 5 are decomposed.

As described above, the cleaning utensil 1 is effective as a brush when cleaning a dry part such as the floor. After cleaning the dry part has been finished, it can also effectively remove dirt on the toilet bowl by wetting it. The toilet bowl and the periphery thereof can be cleaned with a single cleaning utensil 1, moreover the utensil can be disposed of in the flush toilet after cleaning.

Any material may be used as wet shrinkable resin composing the fibers 4 used in the cleaning part 3 provided that it is water soluble resin or water swelling resin which is hydrophilic, shrinks when absorbing water, and is brought into close contact with each other to turn into a mass. It is preferable to use biodegradable resin. For example, modified polyvinyl alcohol resin with a molecular structure effective in thermal plasticity can be used. Starch fiber and align fibers may be used. It is preferable that the fibers 4 to be used in the cleaning part 3 can absorb water weighing three times or more than the original weight of the fiber, as mentioned above, the fiber decreases in length by 20% or more when absorbing ion exchange water with a temperature of 20° C. weighing three times more than the original weight of the fiber.

As stated above, the use of resin which can absorb water weighing three times or more than the original weight of the fiber and decreases in length by 20% or more when absorbing ion exchange water with a temperature of 20° C. weighing three times more than the original weight of the fiber causes fibers to aggregate into mass in a wet state and exhibits cushion property, thereby the bowl surface can be easily wiped up.

FIGS. 4 to 9 show a water disintegrable cleaning utensil in the other embodiments according to the present invention.

Figure 4:
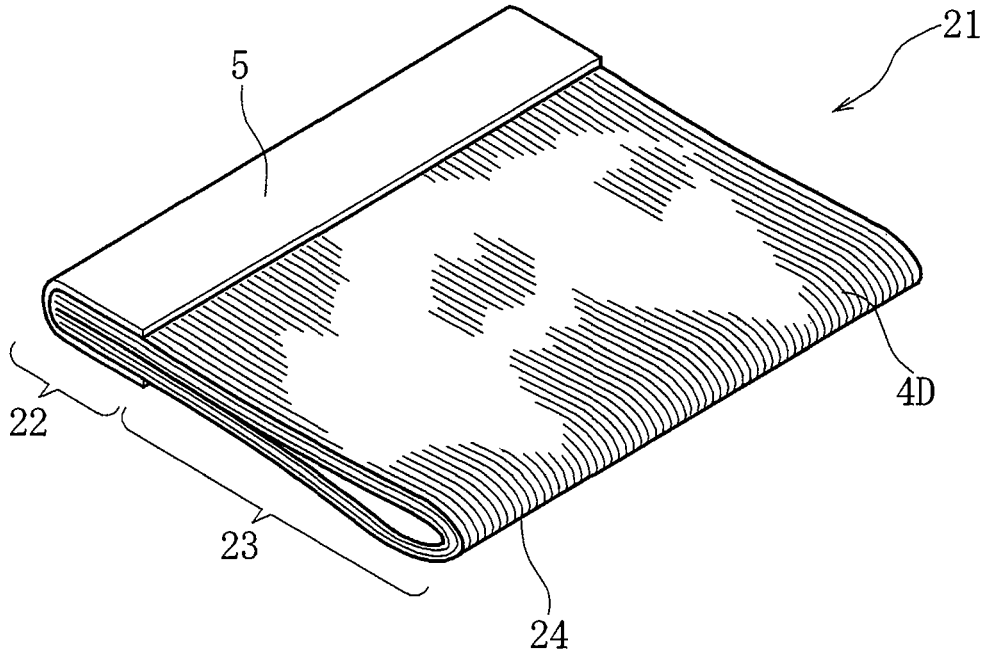
FIG. 4 is a perspective view showing a water disintegrable cleaning utensil according to a second embodiment.

A water disintegrable cleaning utensil 21 in the second embodiment shown in FIG. 4 is formed in such a manner that the tow made of PVA fibers cut into the length twice as long as the tow 4A shown in FIG. 2A and is spread in the direction perpendicular to the fiber to form a fiber bundle 4D. The fiber bundle 4D is folded back at the position half the length of the bundle to form a loop part 24. The ends of the fiber bundle 4D are put together and bonded with water-soluble adhesive and covered by a holding material 5. The holding material 5 and the fiber bundle 4D are bonded with water-soluble adhesive to form a holding part 22. The loop part 24 where the fiber 4D is folded back is positioned at the distal end of a cleaning part 23.

The cleaning utensil 21 is used in a state shown in FIG. 4, or used as cleaning utensil in a state where a plurality of the utensils shown in FIG. 4 are put together and the holding materials 5 are mutually bonded with water soluble adhesive, as is the case with FIG. 3B. In the cleaning utensil 21 shown in FIG. 4, the loop part 24 of the fiber bundle 4D appears at the distal end of the cleaning part 23, so that a dry floor can be cleaned by the loop part 24.

Figure 5:
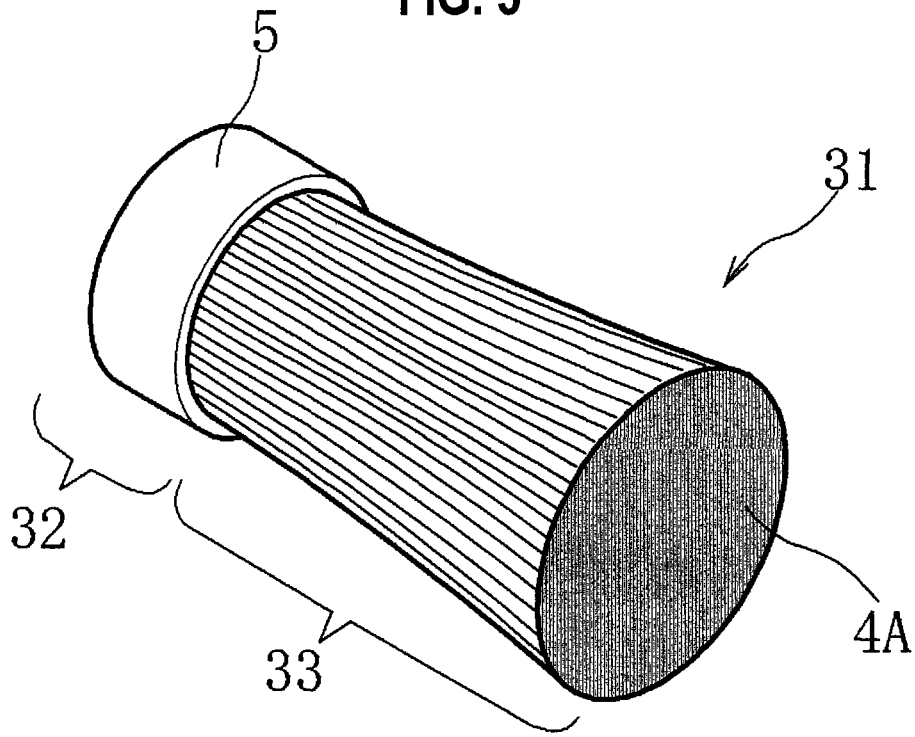
FIG. 5 is a perspective view showing a water disintegrable cleaning utensil according to a third embodiment.

FIG. 5 shows a water disintegrable cleaning utensil 31 in the third embodiment according to the present invention. In a cleaning utensil 31 is used the tow 4A in which the PVA fibers shown in FIG. 2A cylindrically aggregate. The holding material 5 is wound about one end of the tow 4A, and bonded with water-soluble adhesive to form a holding part 32. The tow 4A wound by the holding material 5 at the holding part 32 prevents the fibers composing the tow 4A from decomposing before the tow 4A is attached to the holder. For the holder for holding the cleaning utensil 31, a supporting and a pressing part with cylindrical opposing surfaces are used instead of the supporting part 12 and the pressing part 13 shown in FIG. 1.

In the cleaning utensil 31 shown in FIG. 5, a cleaning part 33 is formed by the tow 4A in which the fibers 4 made of PVA resin aggregate to be compressed and physically brought into a close contact with each other, so that the cleaning part 33 is high in stiffness. Trash and dust can be effectively removed when a dry place such as a floor is swept out by the cleaning utensil 31. During cleaning an external force exerting on the tow 4A of the cleaning part 33 loosens the fibers 4, which turns into the most suitable brush.

A plurality of the tows 4A shown in FIG. 5 may be arranged at the cleaning part and the proximal portion of the plurality of the tows 4A may be fixed by the holding material 5 to form a cleaning utensil in which a plurality of cylindrical brush parts are formed.

Figure 6:
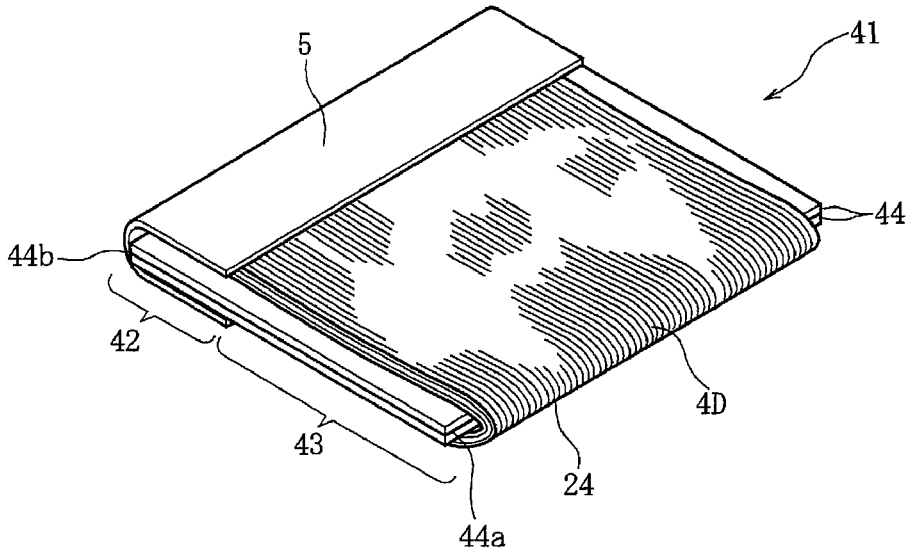
FIG. 6 is a perspective view showing a water disintegrable cleaning utensil according to a fourth embodiment.

FIG. 6 shows a water disintegrable cleaning utensil 41 in the fourth embodiment according to the present invention. A cleaning part 43 of the cleaning utensil 41 is composed of the fiber bundle 4D made of PVA resin and a water disintegrable sheet 44. The fiber bundle 4D is the same as that used in the cleaning utensil 21 shown in FIG. 4.

The water disintegrable sheet 44 is referred to as sheet pulp formed by stacked pulp fibers pressed in the shape of a sheet. The sheet pulp is kept in the shape of a sheet by the hydrogen bonding force of the pulp fiber. The sheet pulp may be such that pulp fibers are bonded together by water-soluble adhesive such as PVA. The sheet pulp has a basis weight of 500 $g/m^2$ to 1000 $g/m^2$, being higher enough in fiber basis weight than a water disintegrable paper (with a basis weight of about 10 g/m$^2$ to 30 g/m$^2$) used as the holding material 5. The water disintegrable sheet 44 formed by sheet pulp is high in basis weight, density, and stiffness.

The cleaning utensil 41 is so formed that the water disintegrable sheet 44 is sandwiched between the folded-back fiber bundles 4D formed by a widely spread tow. A loop part 24 of the fiber bundle 4D is positioned outside the lower side 44*a* of the water disintegrable sheet 44. The ends of the fiber bundle 4D are aligned with the upper side 44*b* of the water disintegrable sheet 44. The water disintegrable sheet 44 is bonded to the fiber bundle 4D by water-soluble adhesive. The fiber bundle 4D is covered with the holding material 5 and bonded thereto by water-soluble adhesive. It is allowable that the sheet 44, fiber bundle 4D, and the holding material 5 are stacked high and subjected to pressure in embossing, or heated and pressed to keep the shape of the holding part 42, by using together with the above bonding, or instead of the above bonding.

The cleaning utensil 41 is so structured that the fiber bundle 4D formed by the fiber 4 made of PVA resin is supported by the sheet 44, providing the cleaning part 43 with stiffness while cleaning both in dry and in wet conditions, which enables the cleaning part 43 to be rubbed hard against a part to be cleaned such as a floor, a toilet bowl, and such. When the cleaning utensil 41 is disposed of in a flush toilet after cleaning, the cleaning utensil 41 is released from the constraint of the holding material 5 and separated into the fiber bundle 4D, the sheet 44, and the holding material 5, and each is disintegrated in water.

It is possible that the cleaning utensil 1 shown in FIG. 3B and the cleaning utensil 31 shown in FIG. 5 also use the foregoing water disintegrable sheet (sheet pulp) 44 together with the fiber 4 made of PVA resin. It is also possible to use a water disintegrable block formed three-dimensionally by fibers being 20 mm or less in length instead of the above sheet 44. The water disintegrable block is such that fibers are compressed to bind them by hydrogen bonding force or fibers are bonded with each other by water-soluble binder.

Figure 7:
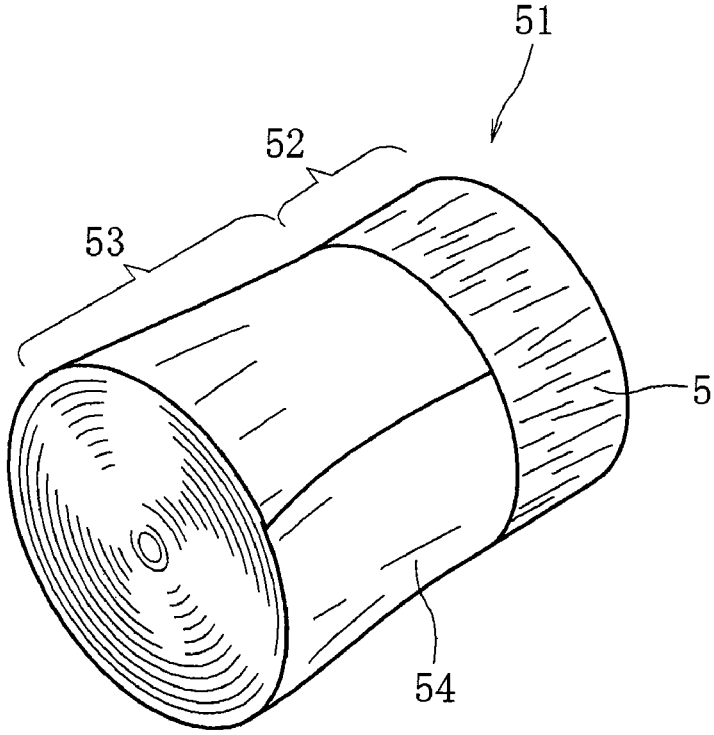
FIG. 7 is a perspective view showing a water disintegrable cleaning utensil according to a fifth embodiment.

FIG. 7 shows a water disintegrable cleaning utensil 51 in the fifth embodiment according to the present invention. The cleaning utensil 51 uses a film 54 formed by wet shrinkable resin that swells and shrinks in wet condition. The film 54 absorbs water to swell in the thickness direction, as a result of which it shrinks to decrease in area. The film 54 is formed by the same PVC resin as in the above resin 4, capable of containing water weighing three times or more than the original weight of the film. The film 54 decreases in length in at least one direction of the film by 20% or more when containing ion exchange water with a temperature of 20° C. weighting three times more than the original weight of the film, or it decreases in area by 20% or more.

The film 54 is tightly wound in a cylindrical shape. The holding material 5 is wound around the periphery of a holding part 52. The holding material 5 is bonded to the film 54 by water soluble adhesive. At the cleaning part 53, the film wound in the cylindrical shape is not bonded with each other, so that it can freely move.

The cleaning utensil 51 is held by the holding part 52 attached to the holder. The holder for holding the cleaning utensil 51 uses a supporting and a pressing part with cylindrical opposing surfaces instead of the supporting part 12 and the pressing part 13 shown in FIG. 1. The cleaning part 53 can remove trash and dust on a dry part to be cleaned such as a floor by the film 54 which is high in density because it is wound thereon in multiple turns. When the film 54 is wetted with water while cleaning a toilet bowl, the film 54 swells and shrinks, then bonds together, thereby PVA resin aggregates into a mass. The mass absorbs a large amount of water, and thus exhibits cushion property as is the case with the mass into which the wet fiber bundle turns, thereby easily removing dirt sticking to a bowl and the like.

Figure 8:
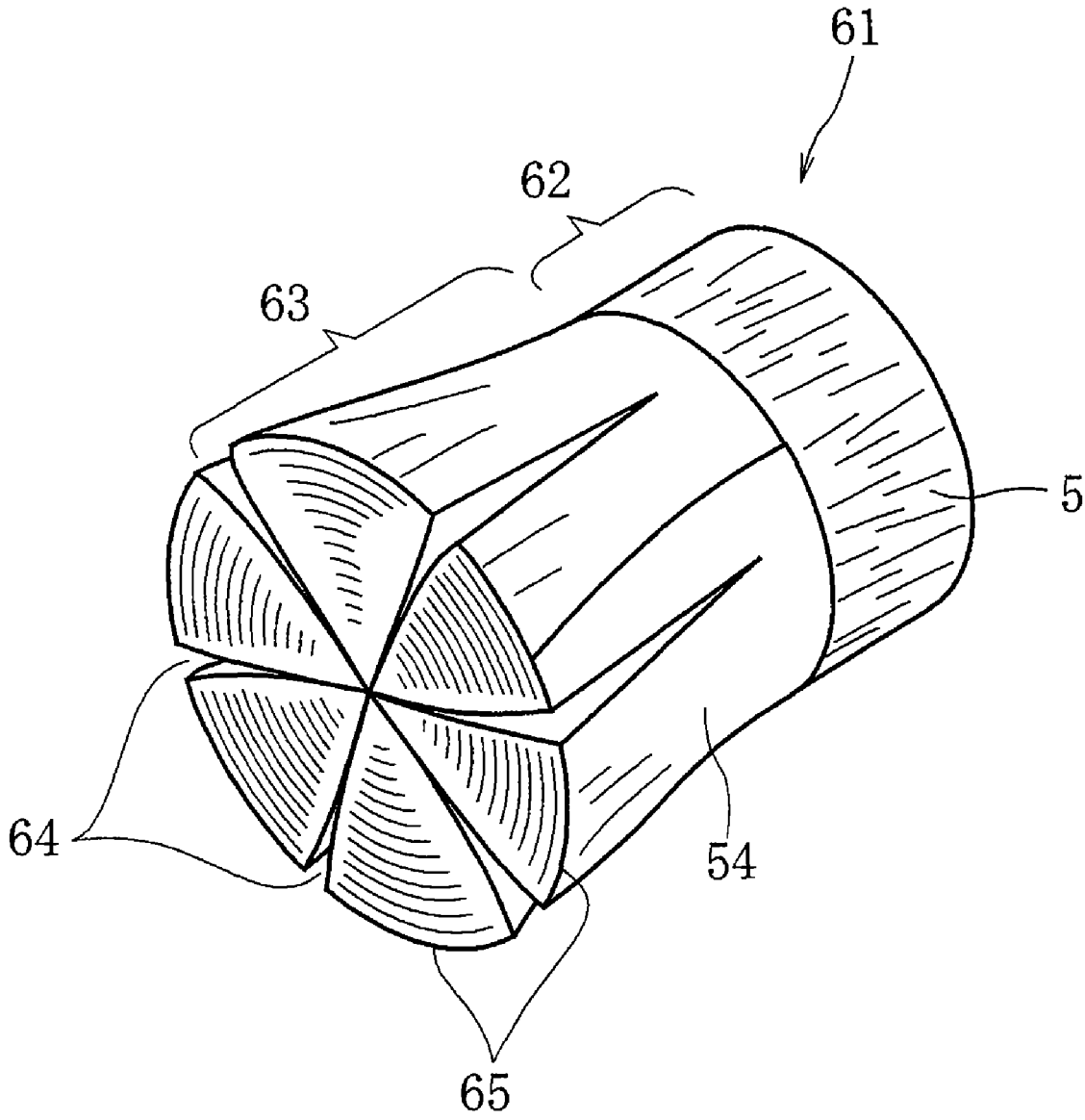
FIG. 8 is a perspective view showing a water disintegrable cleaning utensil according to a sixth embodiment.

FIG. 8 shows a water disintegrable cleaning utensil 61 in the sixth embodiment according to the present invention. In the cleaning utensil 61, the same film 54 as in FIG. 7 is wound in a cylindrical shape. The holding material 5 is wound around the periphery of a holding part 62 and bonded by water-soluble adhesive. In a cleaning part 63, the film wound in a cylindrical shape is cut into the direction along the winding axis to form a plurality of notches 64. As a result, in the cleaning part 63, the film is separated into a large number of strips to form a brush part 65. The notches 64 do not extend to the holding part 62. Therefore, the strips will not be separated before they are attached to the holder.

The cleaning part 63 may be formed in such a manner that cuts are formed in a ribbon-like film 54 with a prescribed pitch to form a large number of strips and then the film 54 is wound in a cylindrical shape.

The cleaning utensil 61 shown in FIG. 8 can remove trash and dust by the strips of the film 54 composing the brush part 65 when cleaning a dry part such as a floor and the like by the cleaning part 63. The holder for holding the cleaning utensil 61 uses a supporting and a pressing part with cylindrical opposing surfaces instead of the supporting part 12 and the pressing part 13 shown in FIG. 1.

Figure 9:
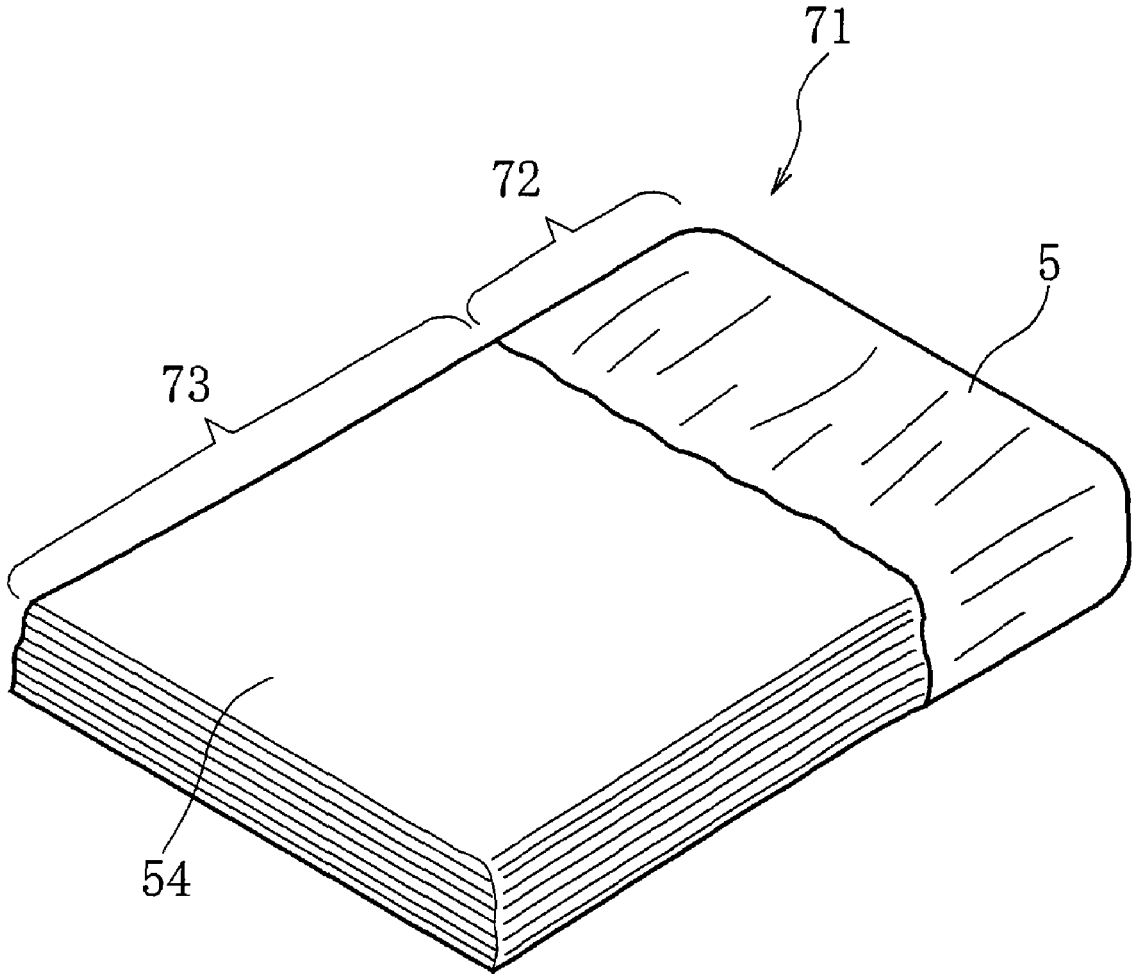
FIG. 9 is a perspective view showing a water disintegrable cleaning utensil according to a seventh embodiment.

FIG. 9 shows a water disintegrable cleaning utensil 71 in the seventh embodiment according to the present invention. The cleaning utensil 71 is formed in such a manner that a film 54 is folded back and stacked up in a plurality of stages, and the holding material 5 is wound around the proximal portion of the film 54 and bonded by water soluble adhesive to form a flat holding part 72.

In the cleaning utensil 71 shown in FIG. 9, a large number of a rectangular film 54 may be stacked and bundled to form the cleaning part 73 instead of folding back the film 54. In this case also, it is possible that a plurality of cuts are made in the film 54 to form a large number of brush-shaped strips.

The water disintegrable cleaning utensil according to the present invention can achieve an excellent cleaning effect both in a dry and in a wet condition and is disintegrable in water when being disposed of after used.

Although the invention has been described above by reference to certain embodiments of the invention, it will occur to these skilled in the art that the invention is not limited to the embodiments described above, in light of the teachings. The scope of the invention is defined with reference to the following claims.

What is claimed is:

1. A water disintegrable cleaning utensil, comprising:

a convertible cleaning part at least part of which is formed by wet shrinkable resin, said resin being hydrophilic and shrinkable at least in one direction when absorbing water and said resin converting from fiber or film form to a hydrogen-bonded mass-shaped aggregate when contacted with water; and a holding part which holds the cleaning part, wherein the cleaning part is provided with a large number of fibers made of the wet shrinkable resin formed by a tow, wherein the fibers are compressed and physically brought into a close contact with each other; and wherein the fibers made of the wet shrinkable resin decrease in length by 20% or more when absorbing ion exchange water with a temperature of 20° C. and weigh three times more after absorbing the ion exchange water than an original weight of the fibers.

2. A water disintegrable cleaning utensil according to claim 1, wherein the cleaning part is provided with films made of the wet shrinkable resin.

3. A water disintegrable cleaning utensil according to claim 2, wherein the film is provided with a plurality of strips separated by cuts.

4. A water disintegrable cleaning utensil according to claim 1, wherein the holding part is made of a water disintegrable holding material for holding the wet shrinkable resin.

5. A water disintegrable cleaning utensil according to claim 1, wherein the holding part is provided with a holder for detachably holding the holding part.

* * * * *